US008207433B1

(12) United States Patent
Maiorana

(10) Patent No.: US 8,207,433 B1
(45) Date of Patent: Jun. 26, 2012

(54) LOCKING POST SYSTEM FOR A GUITAR BRIDGE

(76) Inventor: Christopher P. Maiorana, Grosse Pointe Farms, MI (US)

( * ) Notice: Subject to any disclaimer, the term of this patent is extended or adjusted under 35 U.S.C. 154(b) by 1359 days.

(21) Appl. No.: 11/365,368

(22) Filed: Mar. 1, 2006

(51) Int. Cl.
*G10D 3/00* (2006.01)

(52) U.S. Cl. ..... 84/313; 84/267; 84/290; 84/297 R

(58) Field of Classification Search ..... 84/453, 84/454, 458, 167, 168, 443, 450, 144, 313; D17/21, 99; 74/813; 298/291; 411/285
See application file for complete search history.

(56) References Cited

U.S. PATENT DOCUMENTS

| | | | | |
|---|---|---|---|---|
| 2,074,982 | A | 3/1937 | DiMarzio | 84/307 |
| 3,793,730 | A | 2/1974 | Begg et al. | 433/14 |
| 3,956,962 | A * | 5/1976 | Fields | 84/267 |
| 3,977,425 | A * | 8/1976 | Hayashida | 137/116.3 |
| 4,044,513 | A * | 8/1977 | Deike | 405/259.5 |
| 4,171,661 | A | 10/1979 | Rose | 84/313 |
| 4,254,809 | A * | 3/1981 | Schuster | 411/167 |
| 4,285,262 | A | 8/1981 | Scholtz | 84/313 |
| 4,433,605 | A | 2/1984 | Matsui | 84/299 |
| 4,522,101 | A | 6/1985 | Peavey et al. | 84/1.16 |
| 4,535,668 | A | 8/1985 | Schaller | 84/1.15 |
| 4,555,970 | A | 12/1985 | Rose | 84/313 |
| 4,580,481 | A | 4/1986 | Schaller et al. | 84/1.15 |
| 4,610,190 | A | 9/1986 | Maloney | 84/312 R |
| 4,611,523 | A | 9/1986 | McFarland | 84/313 |
| 4,632,005 | A | 12/1986 | Steinberger | 84/313 |
| 4,656,917 | A | 4/1987 | Van Halen | 84/327 |
| 4,661,031 | A * | 4/1987 | Heine | 411/263 |
| 4,681,010 | A * | 7/1987 | Wilkinson | 84/298 |
| 4,697,493 | A | 10/1987 | Ralston | 84/313 |
| 4,717,302 | A | 1/1988 | Adams et al. | 411/378 |
| 4,724,737 | A | 2/1988 | Fender | 84/313 |
| 4,763,555 | A * | 8/1988 | Minakuchi et al. | 84/313 |
| 4,787,285 | A | 11/1988 | Goto | 84/313 |
| 4,796,505 | A | 1/1989 | Takeuchi | 84/313 |
| 4,811,646 | A | 3/1989 | Hoshino | 84/313 |
| 4,967,631 | A | 11/1990 | Rose | 84/313 |
| 5,083,515 | A * | 1/1992 | Seksaria et al. | 109/49.5 |
| 5,373,769 | A | 12/1994 | Sherman | 84/313 |
| 5,381,715 | A * | 1/1995 | Spercel | 84/304 |
| 5,419,227 | A | 5/1995 | Lavineway | 84/313 |
| 5,438,901 | A | 8/1995 | Sperzel | 84/297 R |
| 5,492,044 | A | 2/1996 | Sperzel | 84/297 R |
| 5,517,891 | A | 5/1996 | Sica | 84/453 |
| 5,520,082 | A | 5/1996 | Armstrong et al. | 84/313 |
| 5,716,055 | A * | 2/1998 | Wilkinson et al. | 277/308 |
| 5,886,270 | A * | 3/1999 | Wynn | 84/313 |
| 6,201,172 | B1 | 3/2001 | Denton | 84/313 |
| 6,462,259 | B1 | 10/2002 | Chapman | 84/314 N |
| 6,563,034 | B2 * | 5/2003 | McCabe | 84/312 R |
| 6,875,911 | B2 | 4/2005 | Schryer | 84/313 |
| 7,183,475 | B2 | 2/2007 | Van Halen | 84/298 |
| 2001/0002570 | A1 * | 6/2001 | McCabe | 84/312 R |
| 2004/0134329 | A1 * | 7/2004 | Turner | 84/298 |

OTHER PUBLICATIONS

James Spring & Wire Company website, Compression Springs, 2004, http://www.jamesspring.com/compression.php.*

* cited by examiner

*Primary Examiner* — Elvin G Enad
*Assistant Examiner* — Christopher Uhlir
(74) *Attorney, Agent, or Firm* — Christopher P. Maiorana, PC

(57) ABSTRACT

An apparatus for a guitar comprising a tremolo anchor, an upper post portion, a lower post portion, and a compressible material. The compressible material is compressible enough to allow for the tightening of the upper post portion but not compressible enough to loosen a guitar string.

15 Claims, 5 Drawing Sheets

LOCKING POST SYSTEM FOR A GUITAR BRIDGE

FIELD OF THE INVENTION

The present invention relates to locking bridges on guitars generally and, more particularly, to a method and/or apparatus for securing the posts in a locking bridge system that does not have a pre-installed set screw.

BACKGROUND OF THE INVENTION

Electric guitars are often equipped with a moveable bridge, sometimes referred to as a tremolo or a whammy bar. Conventional tremolo systems, such as the tremolo used on the Fender Stratocaster guitar sold under the trademark STRATOCASTER™, have conventional tuners, and a conventional nut. Refinements to the conventional tremolo have been made, such as with the Floyd Rose locking system sold under the trademark FLOYD ROSE™. With such a system, the strings use conventional tuners for rough tuning, then the strings lock at the nut. Such a system prevents movement and binding of the strings within the nut. Fine tuners are provided to allow further tuning after the nut has been locked.

In either conventional tremolo system, the posts (also known as studs) that hold the tremolo in place are threaded into anchors that are embedded in the body of the guitar. The anchor makes a physical connection with the wood of the guitar body and has inner threads that allow the height of the posts to be adjusted with the anchors. Adjusting the height of the posts changes the height of the tremolo from the guitar body, which in turn changes the action of the guitar. However, the movement of the posts within the tolerances of the threads can cause the overall tuning of the guitar to be less than desirable. Additionally, movement of the posts back and forth within the tolerances of the threads can cause the anchor, over time, to form an elongated hole within the wood of the guitar. In severe cases, the elongation may be so drastic that the anchor may pull out of the wood with little or no force at all, initiating a trip to a guitar repair shop.

One conventional system used to securely hold the posts and the anchors is to install a small set screw through the middle of the post. The set screw makes contact with the bottom of the anchor to secure the threads of the post to the threads of the anchor. However, not all guitar anchors have a bottom portion that a set screw can connect with. In such a system, there is nothing for the set screw to hold against, other than the wood of the guitar. Having a set screw touch the wood of the guitar does not ensure a snug fit and may damage the wood of the guitar body. Furthermore, posts containing set screws are expensive, may be difficult to locate and may not be available for every type of thread.

One solution to create a secure fit when using bottomless anchors is to first use a flat piece of metal or hard plastic with a thread that can be adjusted with a screwdriver. Such a piece is placed into the anchor first. After making a rough adjustment, the post is secured inside the anchor creating a snug fit. However, such a system has limited flexibility in adjusting the height of the post after the initial installation. Such a lack of adjustment makes the initial setup of a guitar tedious. Also, since guitars are normally adjusted on a periodic basis, the lack of fine tuning of the height of the post is a disadvantage. Another approach would be to simply remove the existing anchor, and replace it with a new anchor and a post with a set screw. However, such a modification requires expertise in removing the old anchor without damaging the finish of the guitar.

It would be desirable to retrofit an existing anchor and post system with a device that would allow securing the post to the anchor, yet still provide fine height adjustments through varying the height of the post.

SUMMARY OF THE INVENTION

The present invention concerns an apparatus for a guitar comprising a tremolo anchor, an upper post portion, a lower post portion, and a compressible material. The compressible material is compressible enough to allow for the tightening of the upper post portion but not compressible enough to loosen a guitar string.

The objects, features and advantages of the present invention include providing an apparatus and/or method for securing a post into an anchor of a guitar tremolo that may (i) reduce the loosening of an anchor within a guitar, (ii) reduce the frequency with which the anchor must be replaced, (iii) create a more secure connection between a pre-existing post and anchor without having to replace either part, (iv) allow for easy tremolo height adjustment and/or (v) avoid over tightening of the post and/or driving the post into the guitar body.

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENTS

Figure 1:
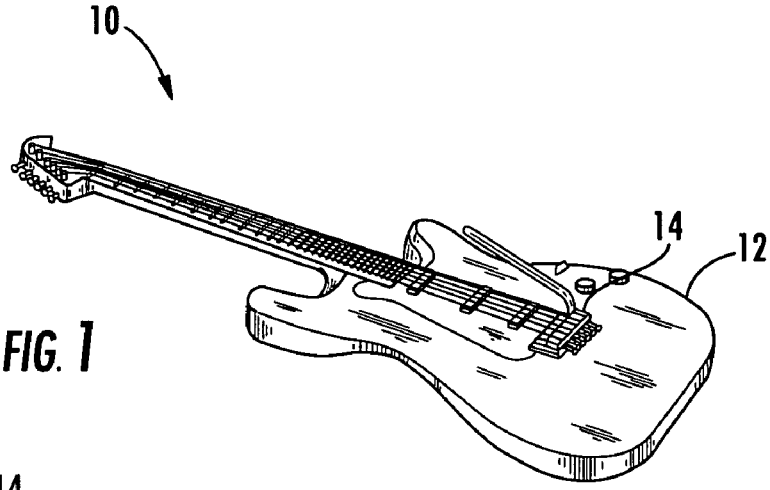
FIG. 1 is a perspective view of an electric guitar.

Referring to FIG. 1, a guitar 10 is shown in the context of the present invention. The guitar 10 generally comprises a guitar body 12 that may serve as the point of attachment for a tremolo 14.

Figure 2:
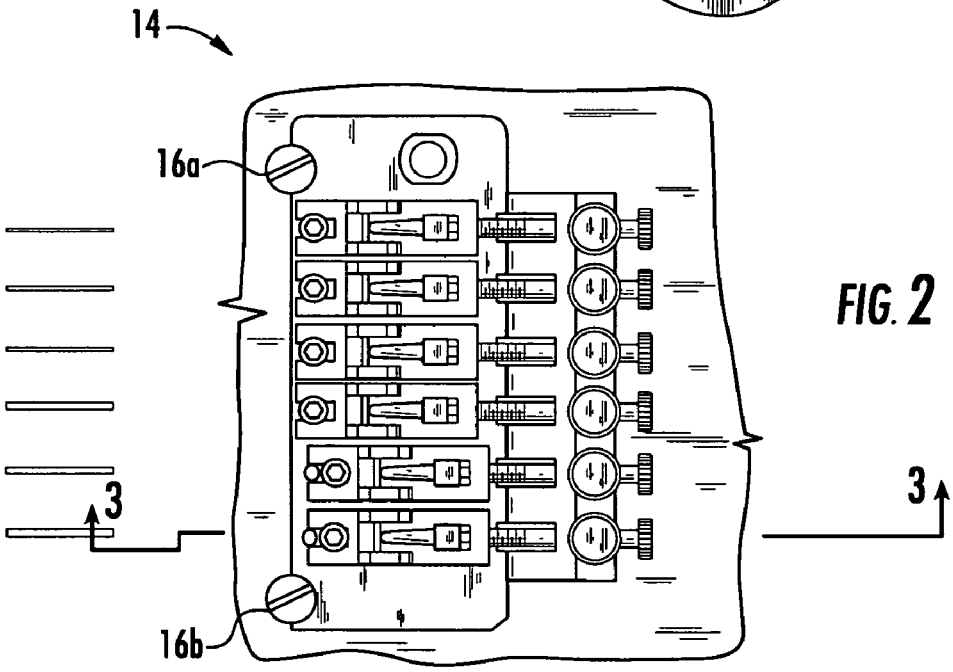
FIG. 2 is a top view of a tremolo.
Figure 3:
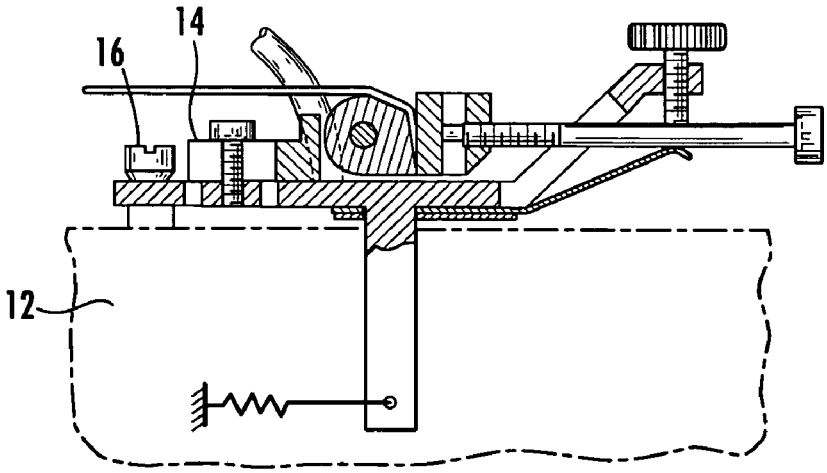
FIG. 3 is a side view of a tremolo.

Referring to FIGS. 2 and 3, more details of the tremolo 14 are shown. The tremolo 14 is held in place against the body 12 by two or more posts **16*a*-16*b*. The posts 16*a*-16*b* generally comprise a threaded metal or plastic screw. The posts 16 are threaded into anchors (not shown) that are embedded in the guitar body 12**.

Figure 4:
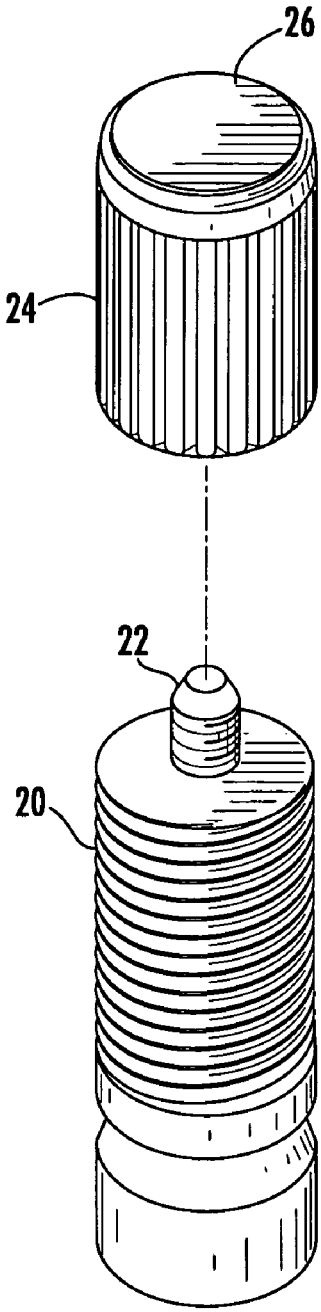
FIG. 4 is a perspective view of a post with a set screw and a perspective view of a "closed" anchor.

Referring to FIG. 4, a post 20 is shown that contains a set screw 22. The post 20 with the set screw 22 is generally threaded into a close-bottomed anchor 24. An open end (not shown) of the close-bottomed anchor 24 may receive the post 20. A closed end 26 may be embedded within the guitar body 12. The post 20 is threaded into the anchor 24 and tightened in place using a screw driver or allen key. The set screw 22 is also then tightened, using a screw driver or alien key. The set screw 22 may be tightened against the closed end 26 of the anchor. Care needs to be taken to avoid over tightening the set screw 22. If the set screw 22 is over tightened, the set screw 22 may protrude through the closed end 26 and make contact with the guitar body 12, which is undesirable. The set screw 22 may further secure the post 20 into the anchor 24 and reduce the lateral movement of the post 20 within the anchor 24.

Figure 5:
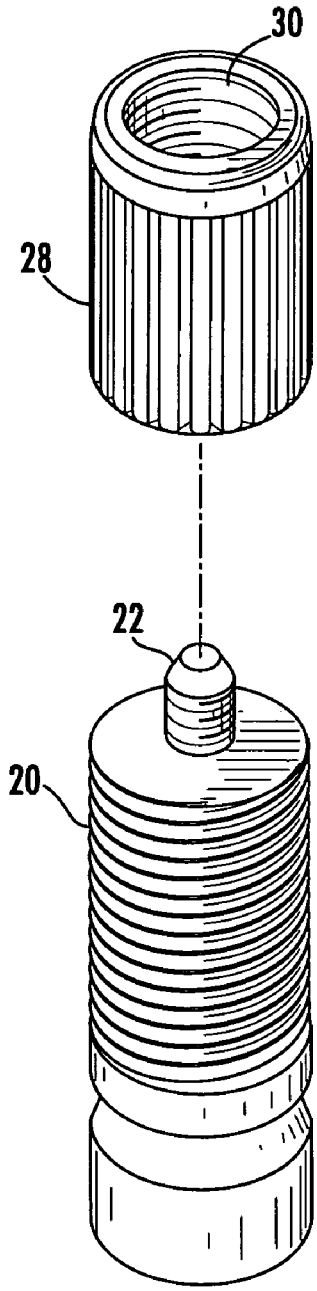
FIG. 5 is a perspective view of a post with a set screw and an "open" anchor.

Referring to FIG. 5, an open-bottom anchor 28 is shown. The open-bottomed anchor 28 may be used with the post 20. A first open end (not shown) of the anchor 28 may receive the post 20. A second open end 30 may be in contact with the guitar body 12. The post 20 is threaded into the anchor 28 using a screw driver or alien key. The set screw 22 is then also tightened using a screw driver or allen key. However, since the anchor 28 does not have a closed end, the set screw 22, when tightened, passes through the opening 30 of the anchor 28 and bores into the wood of the guitar body 12. The boring of the set screw 22 in the guitar body 12 often does not secure the post 20 into the anchor 28 and sometimes causes physical damage to the guitar body 12. The post 20 with the set screw 22 is expensive to purchase, difficult to locate and ineffective when used in conjunction with an open-bottomed anchor 28. Furthermore, replacing an open-bottomed anchor 28 with a closed-bottomed anchor 24 requires expertise and care not to damage the finish of the guitar body since the open-bottomed anchor 28 is embedded within the guitar body 12.

Figure 6:
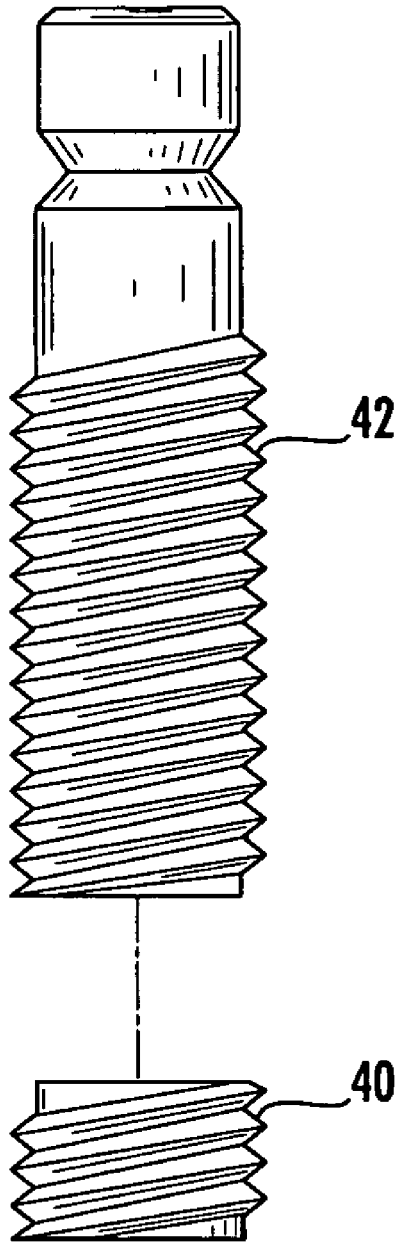
FIG. 6 is a side view of a post with additional flat metal piece.

Referring to FIG. 6, an alternative to using the post 20 with the set screw 22 having a lower post portion 40 and an upper post portion 42 is shown. The lower post portion 40 and the upper post portion 42 may be purchased as a set from a guitar shop. The lower post portion 40 and the upper post 42 may be used in conjunction with the open-bottomed anchor 28. First, the lower post portion 40 is threaded into the anchor 28 and secured at a particular height within the anchor 28 to the specification of the musician. The upper post portion 42 is then threaded into the anchor 28 and tightened to make contact with the lower post portion 40. Once the upper post portion 42 is tightened, further height adjustment cannot be made without taking out the upper post portion. A disadvantage with using the lower post portion 40 and the upper post portion 42 is that such a configuration does not allow for easy adjustment of the height of the lower post portion 40 and the overall height of the tremolo 14. In order for the height of the lower post portion 40 to be adjusted, the upper post portion 42 must first be completely loosened and removed from the anchor 28. The height of the lower post portion 40 is then adjusted to the desired height. Then the upper post portion 42 is rethreaded and tightened against the lower post portion 40. Such a process may have to be repeated a number of times until the desired height of the tremolo 14 is obtained. Therefore, adjusting the height of the tremolo 14 when using the lower post portion 40 and the upper post portion may be very inconvenient and time consuming.

Figure 7:
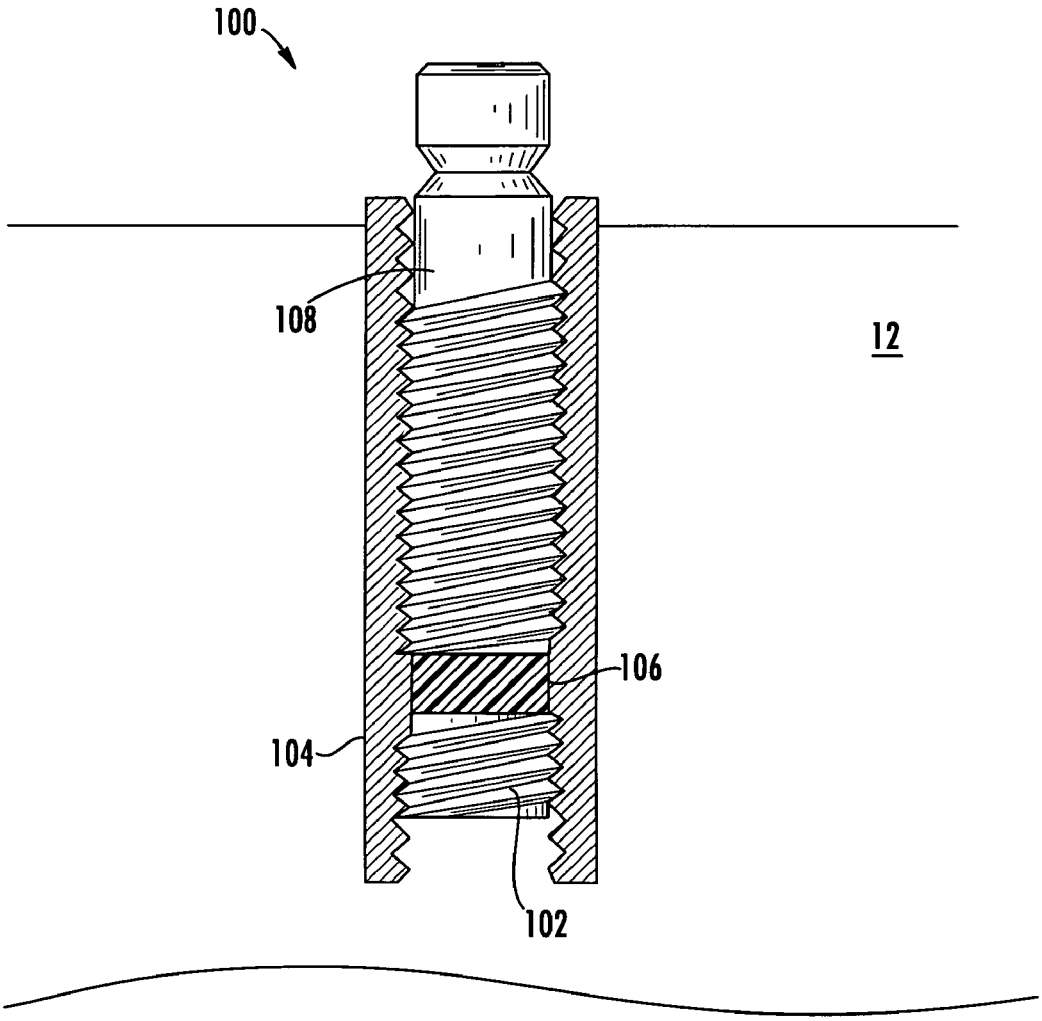
FIG. 7 is a side view of a post, an anchor and a spacer.

Referring to FIG. 7, another system 100 is shown. The system 100 comprises a lower post portion 102 that is threaded into an anchor 104. An upper post portion 108 is secured at a particular height within the anchor 104. The length of the upper post portion 108 may be longer than the length of the lower post portion. The length of the upper post portion 108 and the lower post portion 102 may be varied to meet the design criteria of a particular implementation. A flat piece of compressible material 106 is placed into the anchor 104. The compressible material 106 may be cylindrical in shape. The diameter of the compressible material 106 may be smaller than the diameter of the upper post portion 108 and the lower post portion 102. However, the diameter of the compressible material 106 may be varied to meet the design criteria of a particular implementation.

The compressible material 106 may be positioned below the upper post portion 108 and above the lower post portion 102. The compressible material 106 may be composed of any of a plurality of materials, including but not limited to hard styrofoam, kevlar or hard rubber. The particular type of material used may be varied to meet the design criteria of a particular implementation. The upper post portion 108 may be threaded and secured above the compressible material 106. The compressible material 106 may be compressible enough to accommodate the tightening of the threads of upper post portion 108 by one to two turns. The compressible material 106 may resist compression sufficiently to ensure that the guitar strings do not become loose. The compressible material 106 may cause the threads of the upper portion 108 and the threads of the lower portion 102 to lock into the threads of the anchor 104. The compressible material 106 may maintain the lock, but still permit the adjustment of the upper post portion 108 (and therefore the height of the tremolo 14) without removing the upper post portion 108 and/or having to readjust the position of the lower post portion 102. Therefore, the compressible material 108 makes adjusting the tremolo height 14 easy and much less time consuming than conventional approaches.

The anchor 104 includes an open end below the lower post portion 102. However, the anchor 104 may be also implemented with a closed end (not shown). A gap may be formed between the lower post portion 102 and the closed end. The height of the gap between the lower post portion 102 and the closed end of the anchor 104 may be defined by the position of the lower post portion 102 in the anchor 104.

Rather than purchasing the lower post portion 102 and the upper post portion 108, the lower post portion 102 and the upper post portion 108 may be constructed from the post 16. In a first step, the bottom portion of the post 16 may be chopped off to create two pieces. A first piece may be used as the lower post portion 102. A second piece may be used as the upper post portion 108. In one example, the post 16 may be held in a vice while the bottom portion of the post 16 is chopped off using a saw, utility knife, or other similar tool. The post 16 may be cut so that the lower post portion 102 (i) is long enough to retain enough threads to properly thread into the anchor 104, (ii) remains in the same position when pressure is applied from the compressible material 106, and (iii) does not break when pressure is applied from the upper post portion 108. In a second step, a slot or groove is created in the top surface of the lower post portion 102 to receive the head of a screw driver or an alien key. In a third step, the lower post portion 102 is threaded into the anchor 104 using the screwdriver or allen key and left at the desired height within the anchor 104. In a fourth step, the compressible material 106 is placed above the lower post portion 102. In a fifth step, the upper post portion 108 is threaded into the anchor 104 and tightened until the desired height of the tremolo 14 is obtained.

Figure 8:
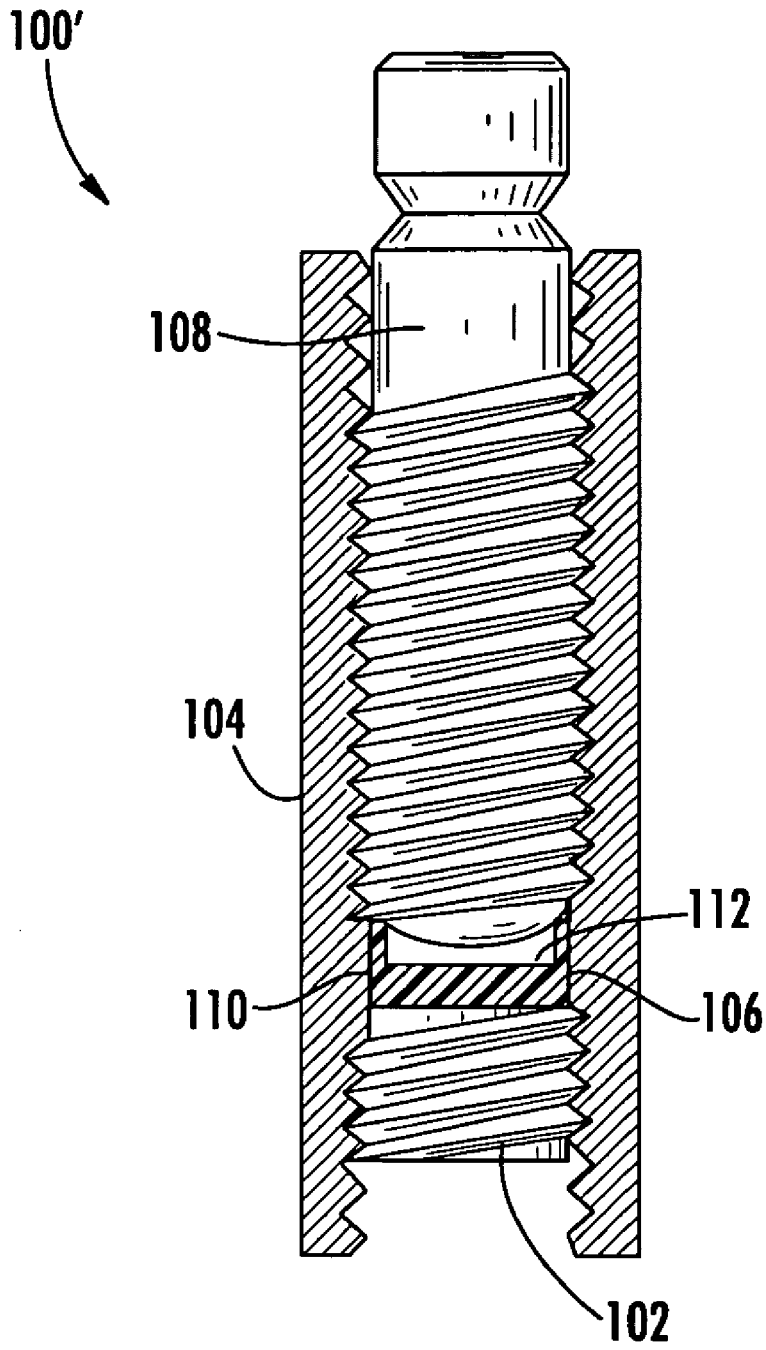
FIG. 8 is a side view of a post, an anchor and alternative spacer.

FIG. 8 illustrates an alternative system 100' of the present invention where the piece of compressible material 112 is not flat. An outer ridge 110 of the compressible material 106 may be taller than the center area of the compressible material 106. Further, a bottom edge 112 of the upper post portion 108 may be rounded using a file, sander or other similar tool. The center area of the compressible material 106 may receive the round bottom edge 112 of the upper post portion 108. The outer ridge 110 of the compressible material 106 may surround the bottom edge 112 of the upper post portion 106. The combination of the outer ridge 110 of the compressible material 106 with the bottom edge 112 of the upper post portion 108 may create a tighter fit between the upper post portion 108 and the compressible material 106. Therefore, the movement of the upper post portion 108 in the anchor 104 may be reduced.

In one example, the compressible material 106 may be shaped in the form of a pyramid. The interior of the pyramid may be hollow. As the upper post portion 108 is screwed in the anchor 104, the top portion of the pyramid may compress in a downward direction. The pyramid shaped compressible material 106 may be implemented to allow the upper post portion 108 to be rotated one to two turns. In particular, the compression of the pyramid shaped compressible material 106 may be implemented to allow the upper post portion 108 to be rotated one to two turns, while still maintaining a snug lock between the threads.

In one example, the compressible material 106 may be shaped into a sphere (or ball). The implementation of the sphere shaped compressible material may allow a user to easily insert the compressible material 106 into the anchor 104. The sphere shaped compressible material 106 may be configured to allow the upper post portion 108 to be rotated one to two turns. The particular shape of the compressible material may be varied to meet the design criteria of a particular implementation.

While the invention has been particularly shown and described with reference to the preferred embodiments thereof, it will be understood by those skilled in the art that various changes in form and details may be made without departing from the spirit and scope of the invention.

The invention claimed is:

1. An apparatus for a guitar comprising:

a tremolo anchor connected to a body of a guitar;

an upper post portion threaded within said anchor;

a lower post portion threaded within said anchor; and a compressible material connected between said upper post portion and said lower post portion, said compressible material being compressible enough to allow for the tightening of said upper post portion but not compressible enough to loosen a set of guitar strings connected to said tremolo, wherein said upper post portion and said lower post portion maintain a consistent intonation of said set of guitar strings.

2. The apparatus according to claim 1, wherein said upper post portion can be tightened without removing said lower post portion from said anchor.

3. The apparatus according to claim 2, wherein said compressible material can accommodate one to two turns of said upper post portion.

4. The apparatus according to claim 1, wherein said compressible material includes an outer ridge and a center area, wherein said outer ridge is taller than said center area.

5. The apparatus according to claim 4, wherein said upper post portion includes a bottom edge that is received by said center area of said compressible material and surrounded by said outer ridge of said compressible material to create a tight fit between said upper post portion and said compressible material.

6. The apparatus according to claim 1, wherein said upper post portion is, longer than said lower post portion.

7. The apparatus according to claim 1, wherein each of said upper post portion and said lower post portion are threadedly received by said tremolo anchor.

8. The apparatus according to claim 1, wherein said compressible material is positioned between said upper post portion and said lower post portion.

9. The apparatus according to claim 1, wherein said lower post portion is positioned at a predetermined height within said tremolo anchor.

10. The apparatus according to claim 1, wherein said compressible material is made from a group consisting of hard styrofoam, kevlar and hard rubber.

11. The apparatus according to claim 1, wherein said compressible material is formed into a shape consisting of a cylinder, a pyramid and a sphere.

12. The apparatus according to claim 1, wherein the diameter of said compressible material is smaller than the diameter of said upper post portion and said lower post portion.

13. An apparatus for a guitar comprising:

a tremolo anchor positioned within said guitar;

a post having an upper post portion and a lower post portion threadedly engaged to said tremolo anchor to couple a tremolo to said guitar; and a compressible material positioned between said upper post portion and said lower post portion configured to adjust a height of said tremolo by compressing when said upper post portion is being rotated.

14. The apparatus according to claim 13, wherein said tremolo anchor is positioned within a body of said guitar.

15. The apparatus according to claim 13, wherein said upper post portion and said lower post portion maintain a consistent intonation of a set of guitar strings connected to said tremolo while adjusting said height of said tremolo.

* * * * *